United States Patent [19]

Tobias

[11] 4,286,816

[45] Sep. 1, 1981

[54] DEVICE FOR COLLECTION AND DISPOSAL OF PET WASTE

[76] Inventor: Emil Tobias, 42 Greenwood La., White Plains, N.Y. 10607

[21] Appl. No.: 161,939

[22] Filed: Jun. 23, 1980

[51] Int. Cl.[3] ..... A01K 29/00

[52] U.S. Cl. ..... 294/1 BA

[58] Field of Search ..... 294/1 R, 1 B, 1 BA, 294/1 BB, 19 R, 19 A, 25, 50, 50.5, 50.7, 55; 15/104 R, 104.8, 142, 221, 236 R, 257.1, 257.3; 30/124, 128, 130, 136, 136.5; 220/85 R, 85 D, 90; 248/99, 101

[56] References Cited

U.S. PATENT DOCUMENTS

| | | | |
|---|---|---|---|
| 1,696,240 | 12/1928 | Kircher | 220/90 |
| 3,718,358 | 2/1973 | Ayers | 294/1 BA |
| 3,740,086 | 6/1973 | Rossitto | 294/1 BA |
| 3,802,728 | 4/1974 | Giacopelli | 294/1 BA |
| 3,823,970 | 7/1974 | Brenner et al. | 294/1 BA |
| 4,020,968 | 5/1977 | Chiavola et al. | 220/90 |

*Primary Examiner*—Johnny D. Cherry

*Attorney, Agent, or Firm*—Martin J. Spellman, Jr.; Richard A. Joel; Russell G. Pelton

[57] ABSTRACT

A device for conveniently collecting pet fecal waste matter and disposing of it. Fecal matter is forced through a rib grid wherein the faces of the ribs have knife edges which taper outwardly to wider flat tops. Fecal matter forced through the grid is retained in a plastic bag that, mounted together with the grid, is then ejected from an open cylindrical container on the handle of the device. Alternatively, the grid is mounted on a disposable metal can container.

2 Claims, 7 Drawing Figures

DEVICE FOR COLLECTION AND DISPOSAL OF PET WASTE

BACKGROUND OF THE INVENTION

With the ever increasing population of dogs in urban areas the problem of dog feces littering sidewalks and other public areas has increased to alarming proportions. Municipal authorities have sought to enforce ordinances requiring "curbing your dog" with a generally universal lack of success. Dog owners are faced with the problem of finding and using very limited areas where they may walk their pet and must be on the alert to curb the dog at the appropriate time. There is a lack of any convenient, inexpensive, and aesthetically acceptable means for collecting and disposing of the animal's feces in a manner which will encourage the practice of cleaning up after the animal. Up until now there has not been an inexpensive, uncomplicated and effective device available that can be used in a sanitary manner to easily pick up dog feces and dispose of it with minimal inconvenience on the part of the dog owner.

Various attempts have been made in the past to provide a device of this sort with varying degrees of success. An example of one such approach is disclosed in U.S. Pat. No. 3,740,086 to Rossitto which concerns a plastic container mounted on the end of a handle. The container comprises a downwardly facing cavity with ribs in it. The downwardly facing end of the container is pressed against the feces to engage a rib pattern of the container and a snap cover placed over the container end. The closed container is then disengaged from the handle by sliding a collar mounted slidably on the handle to force the container from the end of the handle, the container having been held in place by a tubular extension from the top of the container onto the handle. In this case, the whole molded container must be disposed of after each use. In order to disengage the container the slide ring must be operated by hand, thus requiring the user to risk contact with the fecal matter when disengaging the disposable container.

The same general approach is utilized in the sanitary collector of U.S. Pat. No. 3,718,358 to Ayers, wherein the container at the base of the handle is provided with vanes which serve to collect the feces when the device is rotated about the axis of the vertical handle. In this case, the collecting container is disposably secured at the base of the handle by a press-on slot and bar arrangement. A frictionally secured molded cover for the open-end of the collecting container is also provided. The utilization of this device is extremely awkward, requiring a twirling action on the part of the user, and except for the handle, the whole structure must be disposed of after each use.

In U.S. Pat. No. 3,659,891 to Pettenon a collecting device which is utilized for refuse that conceivably could include feces comprises a handle having a tubular element secured to the bottom thereof with the longitudinal axis of the tubular element being parallel to the ground. The tubular element in effect serves as a frame for holding an open plastic bag. The bag with the open end face thereof is simply moved across the ground, the refuse slid into it and the bag is removed from the frame and disposed of when full. In this case, the user must come into direct hand contact with the disposable bag. The effectiveness of the device for picking up animal feces would be extremely limited.

SUMMARY OF THE INVENTION

In accordance with the present invention a device is provided for conveniently and neatly collecting and disposing of pet fecal waste. The device consists of a circular grid of vertically disposed ribs. The lower edges of the ribs are knife-like and have upwardly and outwardly tapering walls terminating in an upper surface significantly wider than the knife edge. The fecal matter is forced through this grid pattern and retained above the top surfaces of the ribs. In a preferred embodiment the ring is removably retained in a cylindrical body and may be removed from the body by the action of a spring biased second cylindrical body slidable within the first cylindrical body. Secured on the annular ring which carries the grid pattern is a flexible plastic bag which normally extends into the interior of the second or inner cylindrical body, with its edges flared back over the external walls of the first cylindrical body to protect the exterior of the first cylindrical body from being smeared with fecal matter. The outer cylindrical body is carried on a handle having means thereon for remotely disengaging the annular ring and plastic bag from the outer cylindrical body.

The special design of the grid pattern also can be incorporated in an inexpensive alternative, wherein, in lieu of a plastic bag, the annular ring with the grid pattern thereon is frictionally retained on the open end of a used metal can such as one normally containing pet food.

BRIEF DESCRIPTION OF THE DRAWING

In the accompanying drawing which forms a part of the specifications.

DESCRIPTION OF THE PREFERRED EMBODIMENTS

Figure 1:
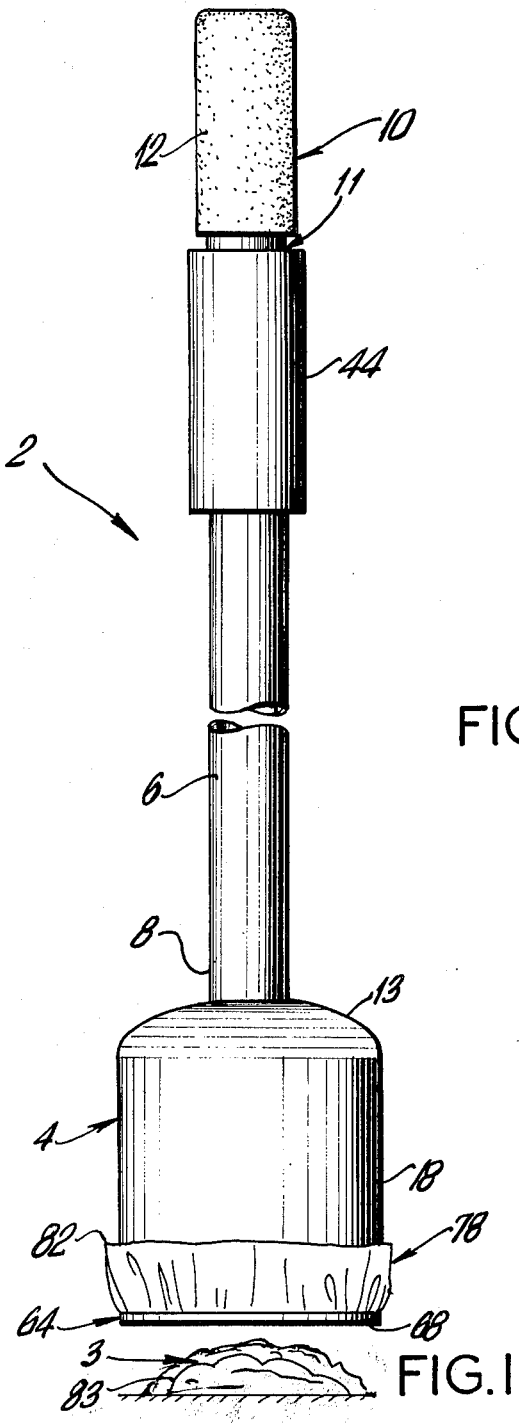
FIG. 1 is a plan view of one embodiment of the device of the present invention showing its use in collecting feces.

Turning now to the accompanying drawing wherein like reference charactors indicate like parts throughout the several figures, the device of the present invention is shown in FIG. 1 and is indicated generally at 2 with the user about to collect a deposit of pet fecal waste 3. As shown more particularly in FIG. 2, the device 2 is comprised of cylindrical body 4 secured to a tubular handle 6 at the base of the lower section 8 of the handle 6. The upper section of the handle 6 is indicated by 10. The upper end 11 of the handle 6 is provided with a rubberized handgrip cover 12 to facilitate gripping by the user.

Figure 2:
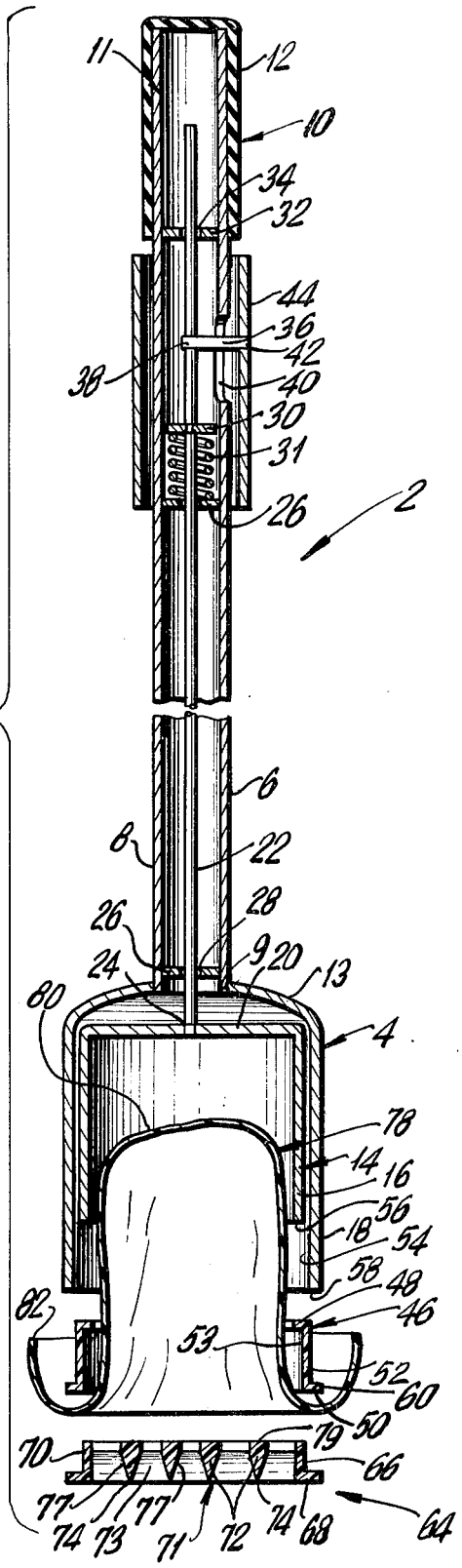
FIG. 2 is a fragmentary side sectional view of the device of FIG. 1 in partially exploded form.

As shown in FIG. 2 the cylindrical body 4 is closed at its upper end 13. Within the cylindrical body 4 is a second and smaller cylindrical body 14 whose annular walls 16 are slightly smaller in their outer diameter than the inner diameter of the annular walls 18 of the larger cylindrical body 4. The walls 16 do not extend downwardly as far as the walls 18 but are spaced from the edge 58 of the walls 18.

The smaller cylindrical body 14 is closed at its upper end by the end wall 20. A longitudinal shaft 22 extends upwardly from the top center 24 of the end wall 20 of the cylindrical body 14, through opening 9 in end 13 of body 4 and then up through the hollow interior of the tubular handle 6. The shaft 22 passes through aperture 28 of a guide ring 26 fixed inside handle 6, and in the upper section 10 of the handle 6 the shaft 22 passes through the guide ring 32 with aperture 34. A ring 30 is fixedly secured to the shaft 22 and a coil spring 31 is compressed between the rings 30 and 26 to normally urge the shaft 22 upwardly, and thereby, the inner cylindrical body 14, to the upper portion of the outer cylindrical body 4.

Above the ring 30 on the shaft 22 a transverse pin 36 extends through the longitudinal slot 40 in the handle 6. The pin 36 is secured at its inner end 38 to the shaft 22 and at its outer end 42 to a cylindrical sleeve 44 having a slightly larger diameter than the outer diameter of handle 6. The sleeve 44 snugly surrounds the handle 6 but is readily slidable up and down thereon. When the sleeve 44 is slid downwardly in respect to the handle 6, it will urge the shaft 22 downward against the tension of the coil spring 31 and consequently, the smaller inner cylindrical body 14 also moves downward with respect to the outer cylindrical body 4.

The respective positions of the cylindrical bodies 4 and 14 are illustrated in detail in FIG. 4 and described further below. In FIG. 2 a molded annular plastic ring 46 has its upper end with an inwardly extending lip 48, its lower end having an outwardly extending lip 50. The interior of wall 52 of the ring 46 is indicated by 53. The lip 50 extends outwardly to end 60, and is of the same diameter as the outer diameter of the walls 18. Lip 50 butts up against the end 58 of walls 18 when the ring 46 is placed as described below.

Figure 4:
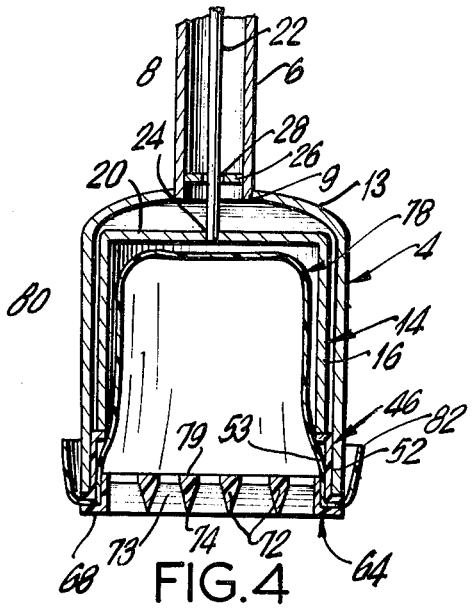
FIG. 4 is a partial side sectional view of the lower portion of the device of FIGS. 1 and 2.
Figure 5:
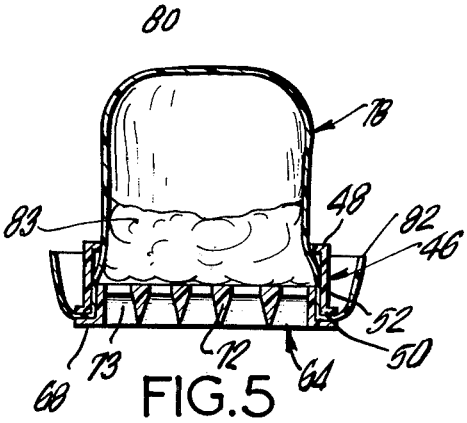
FIG. 5 is also a partial side sectional view of the lower portion of the device of FIGS. 1 and 2 showing release of the bagged waste.

The ring 46 is dimensioned so as to slidingly engage the inner surfaces 54 of the walls 18 and for the lip 48 to meet the ends 56 of the walls 16 of the inner cylindrical body 14 when the ring 46 is pressed in place as shown in FIG. 4.

An outer ring 64 is also molded of a plastic such as polyethylene and comprises the annular walls 66 having the lower portions thereof with an outwardly extending annular lip 68 of the same diameter as lip 58 in the other annular ring 46.

The outer surfaces 70 of the wall 66 are dimensioned so as to slightly engage the inner walls 53 of the annular ring 46 when pressed in place. The ring 64 is provided with a mesh or open grid pattern 71 having ribs 72 and 73 running at right angles to each other.

As shown best in FIG. 2, the ribs 72 and 73 at their downwardly facing ends are in the form of a knife edge 74 and have outwardly tapered walls 77 flaring outwardly from the knife edge 74 to the flat top 79. The ribs 72 and 73 are spaced from about $\frac{1}{4}$ to $\frac{3}{4}$ of an inch apart on their centers and the top 79 is generally from 1/32nd to $\frac{1}{4}$ inches in thickness with 1/16 inches being peferred. This design of the rib grid pattern 71 facilitates cutting through the fecal matter 83, forcing it up through the spaces defined by the ribs 72 and 73. Because the tops 79 of the ribs are significantly wider than the knife edges 74 which initially divide the fecal matter 83, once the fecal matter 83 passes the top 79 it is trapped above in the bag 78.

The ring 64 is dimensioned so that the surfaces 70 of the walls 66 frictionally engage the interior surface 53 of the ring 46.

Figure 3:
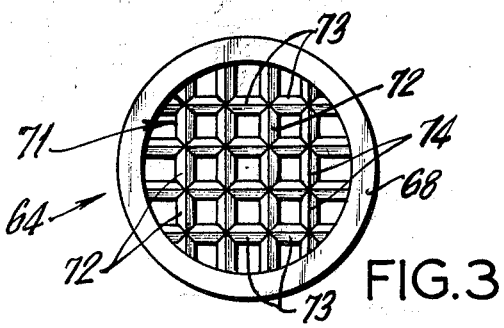
FIG. 3 is an end view of the angular ribbed ring shown in FIG. 2.

As shown in FIGS. 2 and 3 a plastic bag of sandwich size is indicated at 78 with the base 80 extending into the interior of the inner cylindrical body 14 and its edges 82 flared back over the inner ring 46 as shown in FIGS. 2 and 4. The bag 78 is thus held in place between the inner walls of ring 46 and the outer walls of a ring 64 which frictionally engage it. The placement of the bag 78 is best shown in FIG. 4 wherein the device is shown in the assembled position ready to use.

The flared edges 82 of the bag 78 extending back over the walls 18 of the body 4 as well as the ring 46 protect these parts from soiling by the fecal matter 83.

FIG. 4 shows the lower position of the device 2 ready for pressing onto the collection of fecal matter 83 as in FIG. 1.

When the device 2 is pressed down on fecal matter 83 to be collected, the matter 83 is forced through the grid 71 upward into the bag 78, the grid 71 serving both to collect and retain the matter 83. As indicated above, the tops 79 of the ribs 72 and 73 being significantly larger than the knife edges 74 serve to trap the fecal matter 83 above them once it is passed through the grid pattern 71 defined by the ribs 72 and 73 into the bag 78. The flared edges 82 prevent the fecal matter 83 from smearing on the outer walls 18 of the cylindrical outer body 4.

When the deposit is collected and ready for disposal the user simply places the device 2 over a suitable disposal container such as a garbage can or other central waste collector and slides the sleeve 44 downwardly against the tension of the coil spring 31 which moves the smaller cylindrical body 14 downward with the ends 56 of the walls 16 thereof pressing against the lip 48 of the ring 46 and to expel the rings 46 and 64, and bag 78 as shown in FIG. 4.

Figure 6:
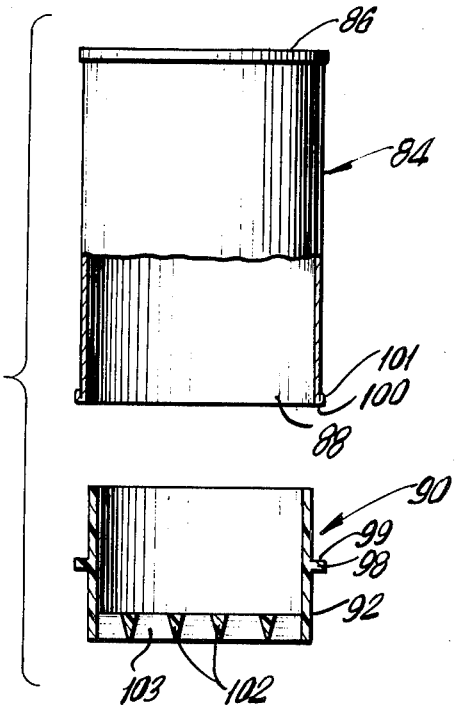
FIG. 6 is an exploded side plan view, partially in section, of an alternative embodiment of the device of this invention.
Figure 7:
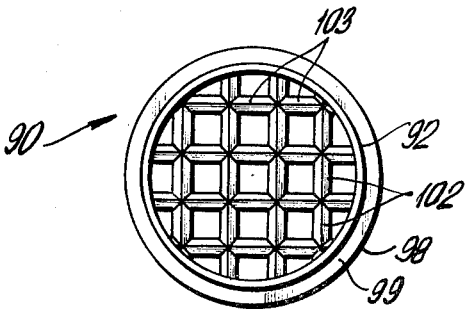
FIG. 7 is an end view of the annular ring portion of the embodiment of FIG. 6.

Referring to FIG. 6, an alternative embodiment of the present invention is shown for use particularly within the home. It is very inexpensive. It utilizes a standard used food can 84 with one end 86 closed and the other end 88 opened. In this case, the embodiment comprises an annular body 90, wherein the outer surface of the annular walls 92 are slightly larger in dimension than the interior diameter of the walls of the can 84. It can be molded in one piece. The body 90 includes annular lip 98 extending outwardly at the midpoint of wall 92 to form a shoulder 99 to engage the edge 100 of the rim 101 of the can 84.

The device is provided with a series of ribs 102 and cross ribs 103 similar to the ribs 72 and 73 in the other embodiment for engaging the fecal matter. In this case, the user grips the can 84 and presses the grid of ribs 102 and 103 on the fecal matter to be collected which is then squeezed into the can and thereafter the can is simply disposed of in the garbage can.

The device of the present invention offers a very efficient and inexpensive means of readily picking up fecal wastes from pets. The device picks up the fecal matter without the user having to go near the fecal matter and permits the user to dispose of the collected waste also without coming in contact. The disposable portion of the device is a minor portion of the device and comprises very inexpensive material. Each disposal can be done for the cost of pennies or less since in the first embodiment the plastic bag 78 and the two rings 46 and 64 are the only materials that are consumed in each use.

In the case of the second embodiment the can is typically of a used pet food container and thus the only additional cost is the plastic ring.

While the invention has been explained by a detailed description of certain specific embodiments, it is understood that various modifications and substitutions can be made in any of them within the scope of the appended claims which are intended also to include equivalents of such embodiments.

What is claimed is:

1. A device for the collection and disposal of fecal waste comprising an outer cylindrical body having an outer end thereof open and an inner closed end, an inner cylindrical body having one end thereof open and one end thereof closed, said inner cylindrical body being positioned within said outer cylindrical body, means for moving said inner cylindrical body longitudinally with respect to said outer cylindrical body, means normally biasing said inner cylindrical body towards the closed end of said outer cylindrical body, a first annular ring having an inwardly extending lip engaging the open end of said inner cylindrical body and an outwardly extending lip engaging the outer end of said outer cylindrical body, a second annular ring having an outer diameter substantially the same as the inner diameter of said first annular ring and an outwardly extending lip adapted to engage an outer edge of said first annular ring, and a grid network of ribs in said second annular ring; and a plastic bag extending into the interior of said inner cylindrical body and between said first and second rings, downwwardly facing ends of said ribs forming knife edges and said ribs having walls flaring outwardly to a wide flat top surface.

2. An annular plastic body, comprising a ring, adapted to frictionally engage the open end of an annular can, including an annular lip extending from the mid-point of said ring, said lip adapted to engage an annular rim at said open end of said can, a grid network of ribs adjacent an end of said annular ring away from said can, said ribs having downwardly facing ends which form a knife edge, and walls flaring outwards from said knife edge to a wide flat top surface which ribs are adapted to collect and retain fecal matter when pressed thereon.

* * * * *